US010403077B2

(12) United States Patent
Kawaguchi et al.

(10) Patent No.: US 10,403,077 B2
(45) Date of Patent: Sep. 3, 2019

(54) COIN BAR UNPACKING APPARATUS

(71) Applicant: TOSHIBA TEC KABUSHIKI KAISHA, Tokyo (JP)

(72) Inventors: Yuki Kawaguchi, Tagata Shizuoka (JP); Koichi Hiruta, Mishima Shizuoka (JP); Naoaki Ide, Shizuoka Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/114,144

(22) Filed: Aug. 27, 2018

(65) Prior Publication Data

US 2019/0122476 A1 Apr. 25, 2019

(30) Foreign Application Priority Data

Oct. 25, 2017 (JP) ..... 2017-205766

(51) Int. Cl.
*G07D 9/00* (2006.01)
*B65B 69/00* (2006.01)
*B67B 7/92* (2006.01)

(52) U.S. Cl.
CPC ..... *G07D 9/004* (2013.01); *B65B 69/0033* (2013.01); *B67B 7/92* (2013.01)

(58) Field of Classification Search
CPC ..... G07D 9/004; B65B 69/0033; B67B 7/92
See application file for complete search history.

(56) References Cited

U.S. PATENT DOCUMENTS 3,781,987 A * 1/1974 Gentscheff ..... B65B 69/0033 30/2
4,333,234 A * 6/1982 Smith ..... G07D 9/00 30/2
4,382,330 A * 5/1983 Harbaugh ..... B65B 69/0033 30/124
4,858,805 A * 8/1989 Hochfeld ..... B26B 27/00 225/2

FOREIGN PATENT DOCUMENTS

JP 2002-32851 A 1/2002

* cited by examiner

*Primary Examiner* — Mark J Beauchaine
(74) *Attorney, Agent, or Firm* — Kim & Stewart LLP

(57) ABSTRACT

A coin bar unpacking apparatus comprises a housing including an opening and a hole configured to accommodate a packed coin bar inserted through the opening, the hole extending in an insertion direction of packed coin bar and decreasing in diameter along the insertion direction such that a first diameter of the hole at a first location is greater than a second diameter of the hole at a second location that is farther from the opening than the first location. An inner surface of the housing at the second location restricts movement of the packed coin bar in a first direction when the packed coin bar is pressed against a rim of the opening in a second direction that is opposite to the first direction.

20 Claims, 9 Drawing Sheets

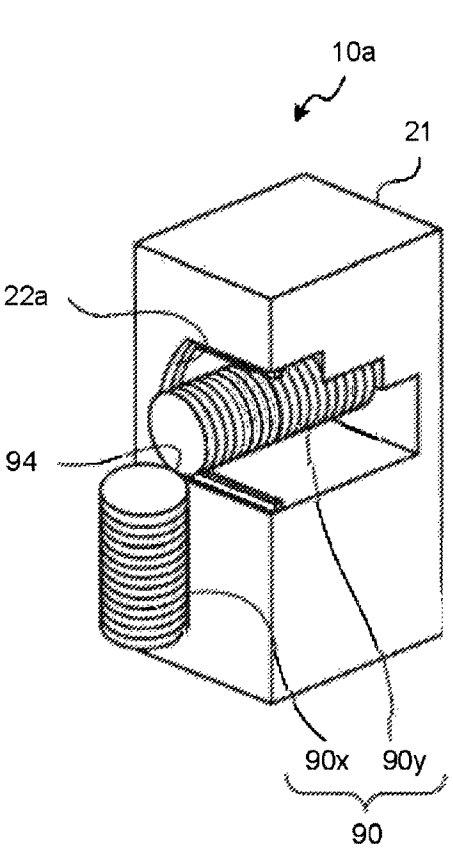
Fig. 6(a)
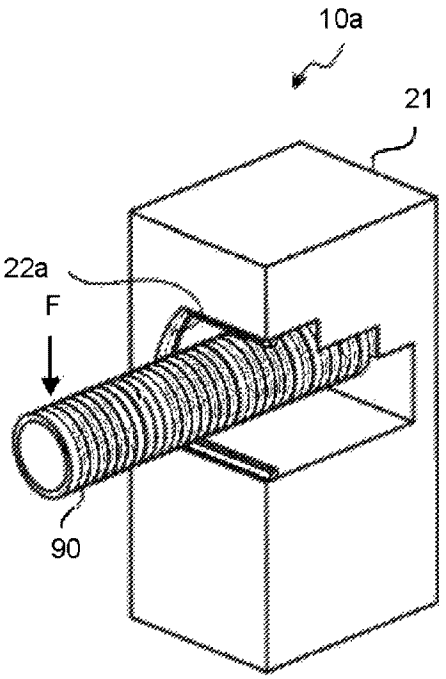
Fig. 6(b)
Fig. 6(c)

COIN BAR UNPACKING APPARATUS

CROSS-REFERENCE TO RELATED APPLICATION

This application is based upon and claims the benefit of priority from Japanese Patent Application No. 2017-205766, filed in Oct. 25, 2017, the entire contents of which are incorporated herein by reference.

FIELD

Embodiments described herein relate generally to a coin bar unpacking apparatus.

BACKGROUND

Conventionally, in a retail store, a coin bar that is obtained by packing a plurality of coins of the same denomination in a bar or columnar shape is used for replenishment of changes. Since the coin bar is packed with a resin film or a paper, at the time of using the coins, it is necessary to break the package and unpack it. Therefore, for example, there is known an example in which the coin bar is unpacked by inserting the coin bar in a hole provided with a cutter and then tearing the film or paper using the cutter.

However, in such a coin bar unpacking apparatus, in order to keep the cutter sharp, it is necessary to periodically replace the cutter blade. In addition, since the cutter is used, there is a possibility of injury to a human body as a result of inadvertent contact with the cutter.

DESCRIPTION OF THE DRAWINGS

FIG. 6(*a*) is a perspective view externally illustrating a coin bar unpacking apparatus according to a second embodiment, FIG. 6(*b*) is a perspective view externally illustrating a state in which the coin bar is inserted into the coin bar unpacking apparatus, and FIG. 6(*c*) is a perspective view externally illustrating a state in which the coin bar is unpacked with the coin bar unpacking apparatus;

DETAILED DESCRIPTION

In accordance with an embodiment, a coin bar unpacking apparatus comprises a housing including an opening and a hole configured to accommodate a packed coin bar inserted through the opening, the hole extending in an insertion direction of packed coin bar and decreasing in diameter along the insertion direction such that a first diameter of the hole at a first location is greater than a second diameter of the hole at a second location that is farther from the opening than the first location. An inner surface of the housing at the second location restricts movement of the packed coin bar in a first direction when the packed coin bar is pressed against a rim of the opening in a second direction that is opposite to the first direction.

First Embodiment

Figures 1A, 1B, 1C:
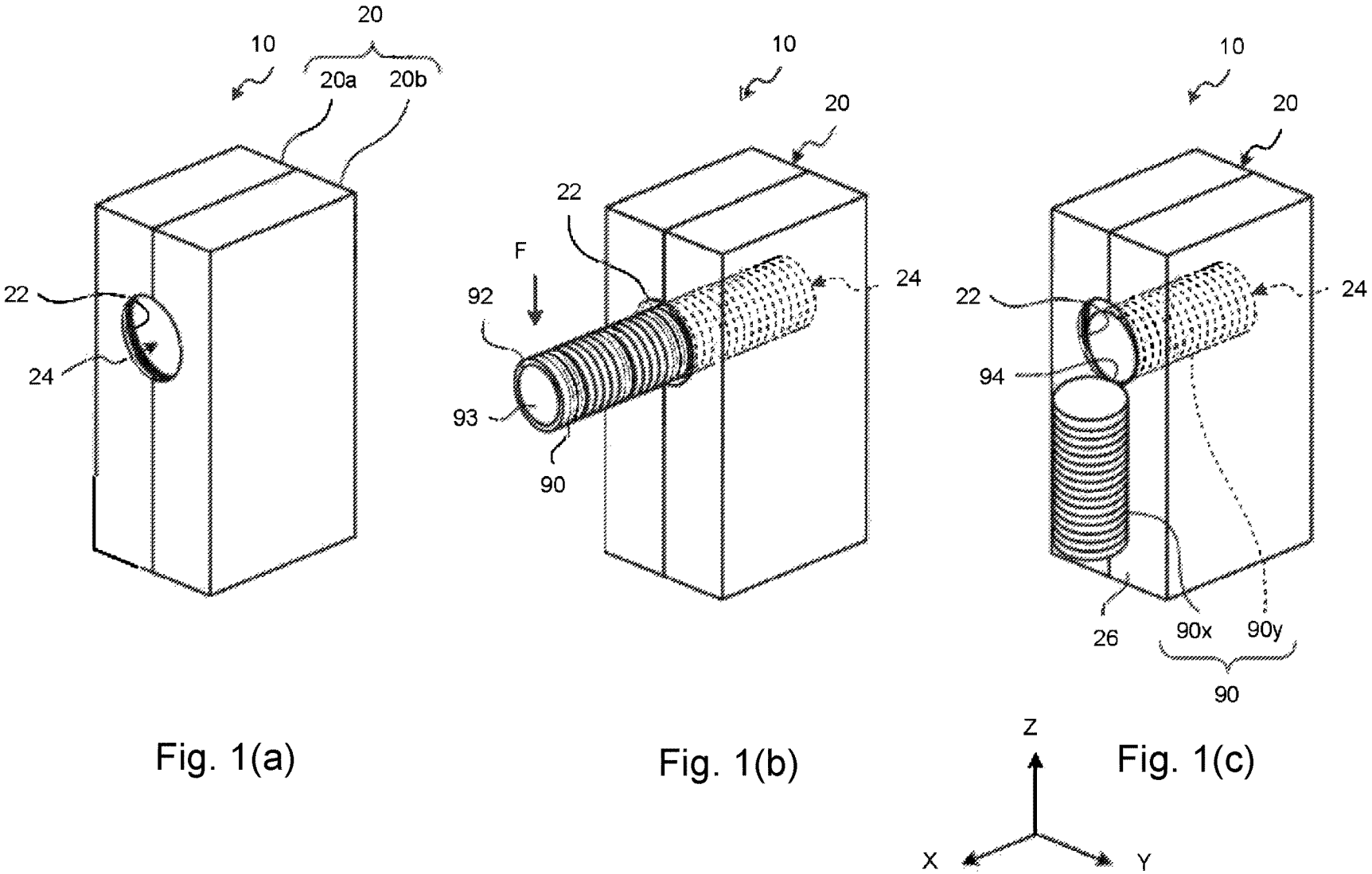
FIG. 1(*a*) is a perspective view externally illustrating a coin bar unpacking apparatus according to a first embodiment, FIG. 1(*b*) is a perspective view externally illustrating a state in which the coin bar is inserted into the coin bar unpacking apparatus, and FIG. 1(*c*) is a perspective view externally illustrating a state in which the coin bar is unpacked with the coin bar unpacking apparatus.

First, with reference to FIG. 1, a coin bar unpacking apparatus is described. FIG. 1(*a*) is a perspective view externally illustrating a coin bar unpacking apparatus 10, FIG. 1(*b*) is a perspective view externally illustrating a state in which a coin bar 90 is inserted into the coin bar unpacking apparatus 10, and FIG. 1(*c*) is a perspective view externally illustrating a state in which the coin bar 90 is unpacked with the coin bar unpacking apparatus 10.

(Description of Functions of the Coin Bar Unpacking Apparatus)

As shown in FIG. 1(*a*), the coin bar unpacking apparatus 10 has a hole 24 having an opening 22 in a substantially rectangular parallelepiped housing 20. The housing 20 is formed by joining a housing 20*a* and a housing 20*b* by bonding, screwing, or the like. The opening 22 is formed at a junction between the housing 20*a* and the housing 20*b* and has a shape (for example, a substantially circular shape) into which the coin bar 90 can be inserted. The hole 24 is formed from the opening 22 towards the inside of the housing 20 such that the coin bar 90 can be inserted to a depth corresponding to about half the length of the coin bar 90. The specific internal structure of the hole 24 is described later. For the sake of the following description, a XYZ coordinate system is set by setting a direction in which the hole 24 of the coin bar unpacking apparatus 10 extends as a X axis, a width direction of the coin bar unpacking apparatus 10 as a Y axis, and a height direction of the coin bar unpacking apparatus 10 as a Z axis.

As shown in FIG. 1(*b*), the coin bar 90 can be inserted into the hole 24 continuous to the opening 22 of the housing 20. The coin bar 90 is obtained by stacking a plurality of coins 93 of the same denomination in a cylindrical shape and packaging them with a film 92. The coin bar 90 is generally formed by packing coins which may be currency, medals used in a game machine, etc. in a bar shape. In the present embodiment, for example, the coin bar 90 in which fifty coins 93 are stacked is described as an example.

With the coin bar 90 inserted into the hole 24, a pressing force in a Z axis negative direction that is substantially orthogonal to the direction of the bar shape 90, (i.e., a direction indicated by an arrow F) shown in FIG. 1(*b*) is applied to one end of the coin bar 90 which is not inserted into the hole 24. Then, as shown in FIG. 1(*c*), the film 92 packaging the coin bar 90 is unpacked at the opening 22 of the hole 24. Details of an unpacking mechanism are described later.

If the coin bar 90 is unpacked, the film 92 at a position on the Z axis negative side of the film 92 packaging the coin bar 90 remains partially uncut shown as a residual film part 94. In this way, the coin bar 90 is divided into a coin bar slice 90*x* hanging out of the housing 20 and a coin bar slice 90*y* left in the hole 24. The housing 20 has a colliding section 26 where the coin bar slice 90*x* collides. The colliding section 26 is formed so as to be substantially flush with the surface formed by the periphery of the opening 22, and the side surface of the coin bar slice 90*x* collides with the colliding section 26. In the example in FIG. 1(*c*), an outer peripheral surface of the housing 20, which is continuous to the periphery of the opening 22, becomes the colliding section 26. In order to unpack the film 92, it is preferable that the coin bar slice 90*x* and the coin bar slice 90*y* after unpacking form an angle of approximately 90 degrees. In other words, it is desirable that the insertion direction of the coin bar 90 and the surface where the colliding section 26 is formed form an angle of approximately 90 degrees therebetween.

An operator who unpacks the coin bar 90 takes out the coin bar slice 90*x* and the coin bar slice 90*y* from the housing 20 by gripping the coin bar slice 90*x* and pulling it out from the hole 24. Subsequently, the operator unpacks both the coin bar slice 90*x* and the coin bar slice 90*y* from the position of the residual film section 94 by pulling the coin bar slice 90*x* and the coin bar slice 90*y* to take out the coins.

(Description of Internal Structure of the Coin Bar Unpacking Apparatus)

Figure 2:
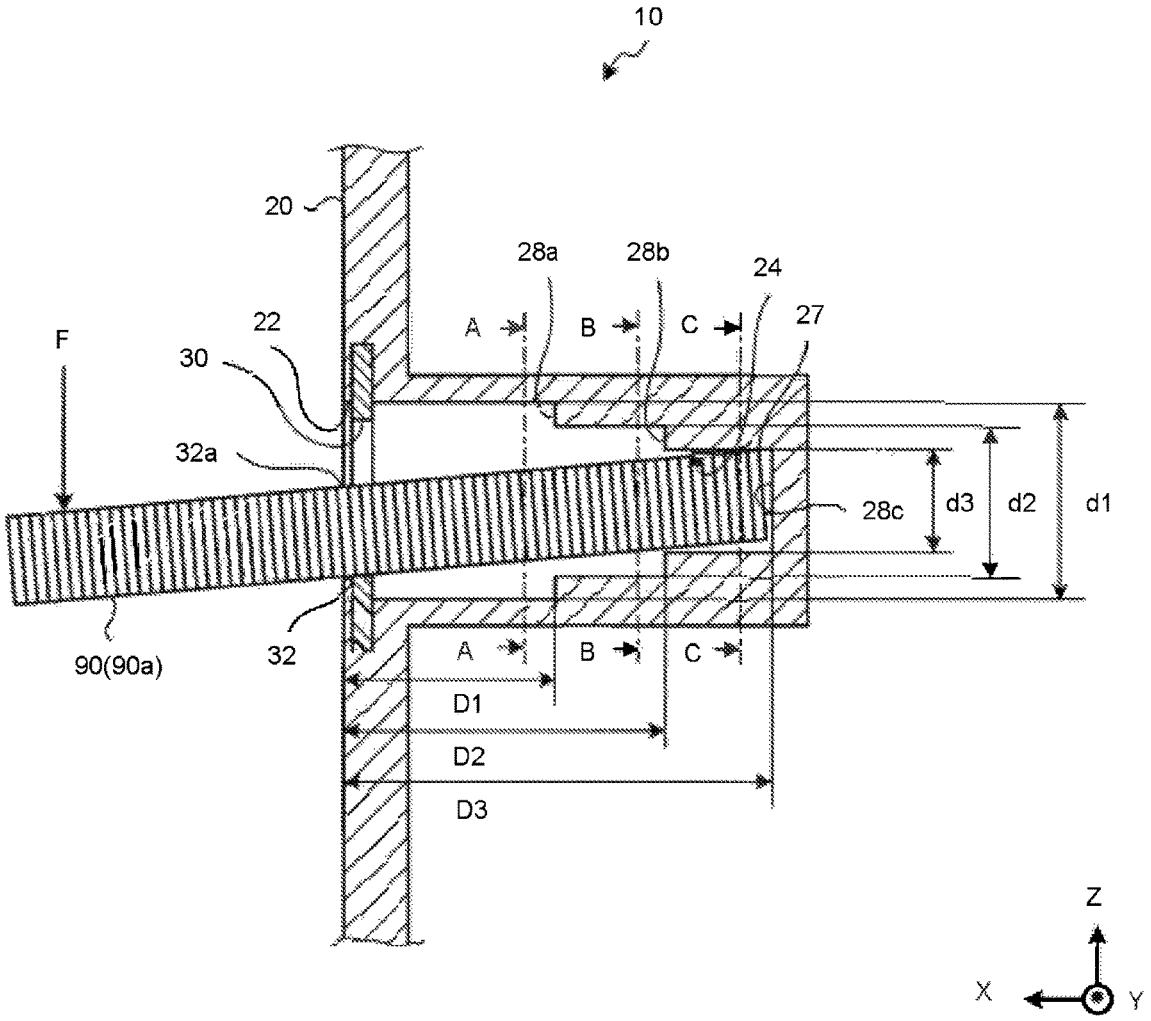
FIG. 2 is a cross-sectional view along XZ plane in which a part of the coin bar unpacking apparatus is cut at a substantially center of a hole according to the first embodiment.

Next, the internal structure of the coin bar unpacking apparatus 10 is described with reference to FIG. 2 and FIG. 3. FIG. 2 is a cross-sectional view along XZ plane in which a part of the coin bar unpacking apparatus 10 is cut at a substantially center of the hole 24.

The hole 24 is formed continuous to the opening 22, has a depth corresponding to a coin bar 90*a* at which the coin bar 90*a* can be inserted, and has a diameter corresponding to the diameter of the coin bar 90*a*. In the coin bar unpacking apparatus 10 shown in FIG. 4, the hole 24 is formed in a substantially circular shape. In the hole 24, a first bottom 28*a*, a second bottom 28*b*, and a third bottom 28*c* are formed stepwise, respectively. The first bottom 28*a* is formed at a position corresponding to a depth D1 from the opening 22. The second bottom 28*b* is formed at a position corresponding to a depth D2 from the opening 22. The third bottom 28*c* is formed at a position corresponding to a depth D3 from the opening 22.

A diameter d1 of the first bottom 28*a* is set to, for example, d1=27 mm. A diameter d2 of the second bottom 28*b* is set to, for example, d2=24 mm. The diameter d3 of the third bottom 28*c* is set to, for example, d3=21.5 mm. In other words, the coin bar 90 having a diameter within the diameter d3 can be inserted to the position of the third bottom 28*c*. The coin bar 90 having a diameter between the diameter d2 and the diameter d3 (where d3<d2) can be inserted to the position of the second bottom 28*b*. The coin bar 90 having a diameter between the diameter d2 and the diameter d1 (where d2<d1) can be inserted to the position of the first bottom 28*a*.

For coins used in Japan, six types are used. The diameter of a 1 yen coin is 20.0 mm, the diameter of a 5 yen coin is 22.0 mm, the diameter of a 10 yen coin is 23.5 mm, the diameter of a 50 yen coin is 21.0 mm, the diameter of a 100 yen coin is 22.6 mm, and the diameter of a 500 yen coin is 26.5 mm. Then, the 1 yen coin and the 50 yen coin having small diameters can be inserted to the position of the third bottom 28*c*. The 5 yen coin, the 10 yen coin and the 100 yen coin having intermediate diameters can be inserted to the position of the second bottom 28*b*. Then, the 500 yen coin having a large diameter can be inserted to the position of the first bottom 28*a*. Hereinafter, for convenience of description, the coin bar 90 of the 1 yen coin and the coin bar 90 of the 50 yen coin are referred to as the coin bar 90*a*. The coin bar 90 of the 5 yen coin, the coin bar 90 of the 10 yen coin and the coin bar 90 of the 100 yen coin are referred to as a coin bar 90*b* (not shown). The coin bar 90 of the 500 yen coin is referred to as a coin bar 90*c* (not shown). FIG. 2 shows an example in which the coin bar 90*a* is inserted to the position of the third bottom 28*c*.

A depth D1 of the first bottom 28*a*, a depth D2 of the second bottom 28*b* and a depth D3 of the third bottom 28*c* are preferably set in such a manner that a length of a portion of the coin bar 90 which inserted into the hole 24 is substantially equal to that of a portion of the coin bar 90 which is not inserted into the hole 24 when the coin bar 90 is inserted to the back side of the hole 24. For example, it is set that D1=about 30 mm, D2=about 40 mm, D3=about 50 mm. By setting the depth D1, D2 and D3 of the hole 24 in this manner, the length of the portion of the coin bar 90 which is not inserted into the hole 24 is substantially half the length of the coin bar 90, and thus, when unpacking the coin bar 90, it is easier to apply a pressing force to the portion projecting from the housing 20, i.e., the side which is not inserted into the hole 24 of the coin bar 90.

In the vicinity of the opening 22, a wrapping member 30 having an opening area slightly narrower than that of the opening 22 is arranged. The wrapping member 30 is a plate-like member made of metal such as iron, for example.

In the state shown in FIG. 2, if the pressing force in the arrow F direction substantially orthogonal to the direction of the coin bar 90*a* is applied to the end of the coin bar 90*a* which is not inserted into the hole 24 while the coin bar 90*a* is in a state of being inserted into the hole 24, the coin bar 90*a* abuts against a wall surface of the hole 24 at an abutting section 27 in the vicinity of the third bottom 28*c*. In other words, the abutting section 27 is formed in the hole 24 and restricts movement of the coin bar 90*a* in a direction other than the insertion direction. Furthermore, as shown in FIG. 2, the coin bar 90*a* is abutting against the wrapping member 30 at a pressure reception section 32. In other words, the pressure reception section 32 is formed in the vicinity of the opening 22, and receives the pressing force in the direction substantially orthogonal to the direction of the coin bar 90*a* to one end, which is not inserted into the hole 24, of the coin bar 90*a*. The shape of the pressure reception section 32 is determined by the shape of the wrapping member 30. Specifically, the pressure reception section 32 may be abut against the outer surface of the coin bar 90*a* at one point, or the pressure reception section 32 may be abut against a part of an arc formed by the outer surface of the coin bar 90*a* in a curved manner.

Next, the sectional shape of the hole 24 is described with reference to FIG. 3. FIG. 3 is a cross-sectional view along the YZ plane illustrating the internal structure of the hole 24 of the coin bar unpacking apparatus 10 shown in FIG. 2, and FIG. 3(*a*) is a sectional view taken along a line A-A. FIG. 3(*b*) is a cross-sectional view taken along a line B-B. FIG. 3(*c*) is a cross-sectional view taken along a line C-C.

Figures 3A, 3B, 3C:
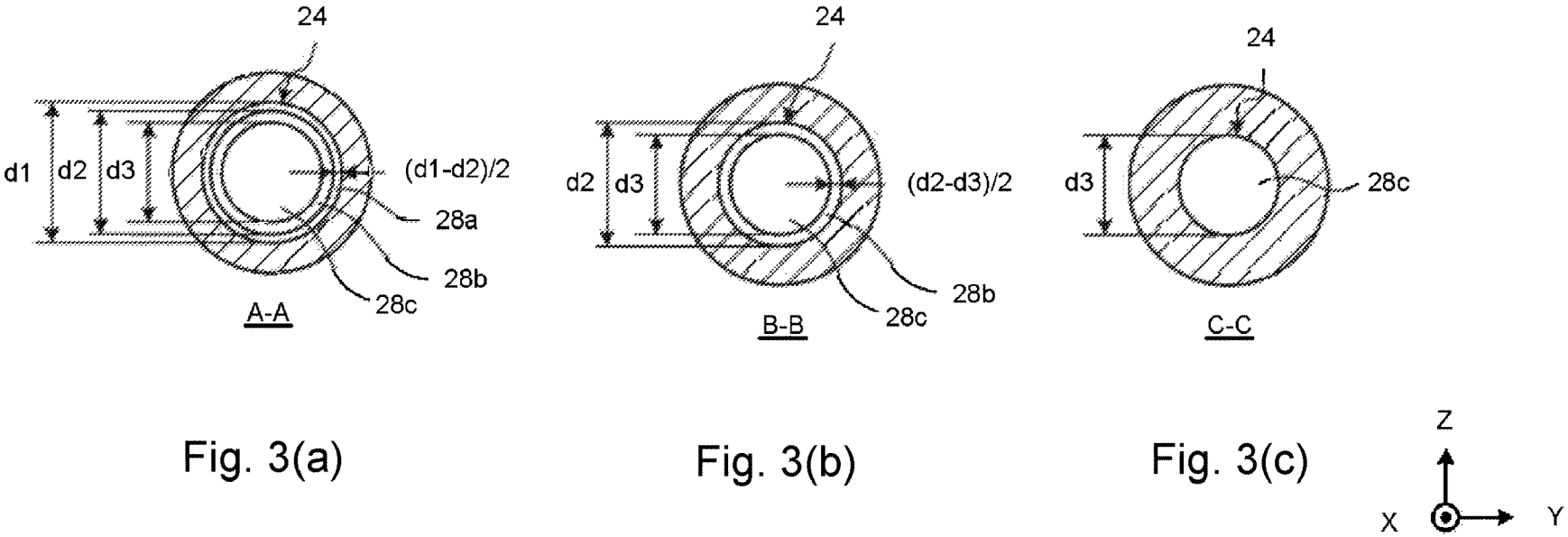
FIGS. 3(*a*)-(*c*) are cross-sectional views along YZ plane illustrating an inner structure of the hole of the coin bar unpacking apparatus shown in FIG. 2, FIG. 3(*a*) is a cross-sectional view taken along a line A-A, FIG. 3(*b*) is a cross-sectional view taken along a line B-B, and FIG. 3(*c*) is a cross-sectional view taken along a line C-C.

As shown in FIG. 3(*a*), in the hole 24, the first bottom 28*a*, the second bottom 28*b*, and the third bottom 28*c* are formed stepwise. The first bottom 28*a* is a region whose peripheral border has a width (d1−d2)/2 in the hole 24 having the diameter d1. The coin bar 90*c* (not shown) can be inserted to the position of the first bottom 28*a*. The region at the inner side of the first bottom 28*a* is formed into a substantially circular shape, and the region has an area at which the coin bar 90*a* (refer to FIG. 2) and the coin bar 90*b* (not shown) can pass.

As shown in FIG. 3(*b*), the second bottom 28*b* is a region whose peripheral border has a width (d2−d3)/2 in the hole 24 having the diameter d2. The coin bar 90*b* (not shown) can be inserted to the position of the second bottom 28*b*. The region at the inner side of the second bottom 28*b* is formed into a substantially circular shape, and the region has an area at which the coin bar 90*a* (refer to FIG. 2) can pass.

As shown in FIG. 3(*c*), the third bottom 28*c* is a region of the hole 24 having a diameter d3, and has a substantially circular shape. Then, the coin bar 90*a* (refer to FIG. 2) can be inserted to the position of the third bottom 28*c*.

(Description of Operation of the Coin Bar Unpacking Apparatus)

Figure 4:
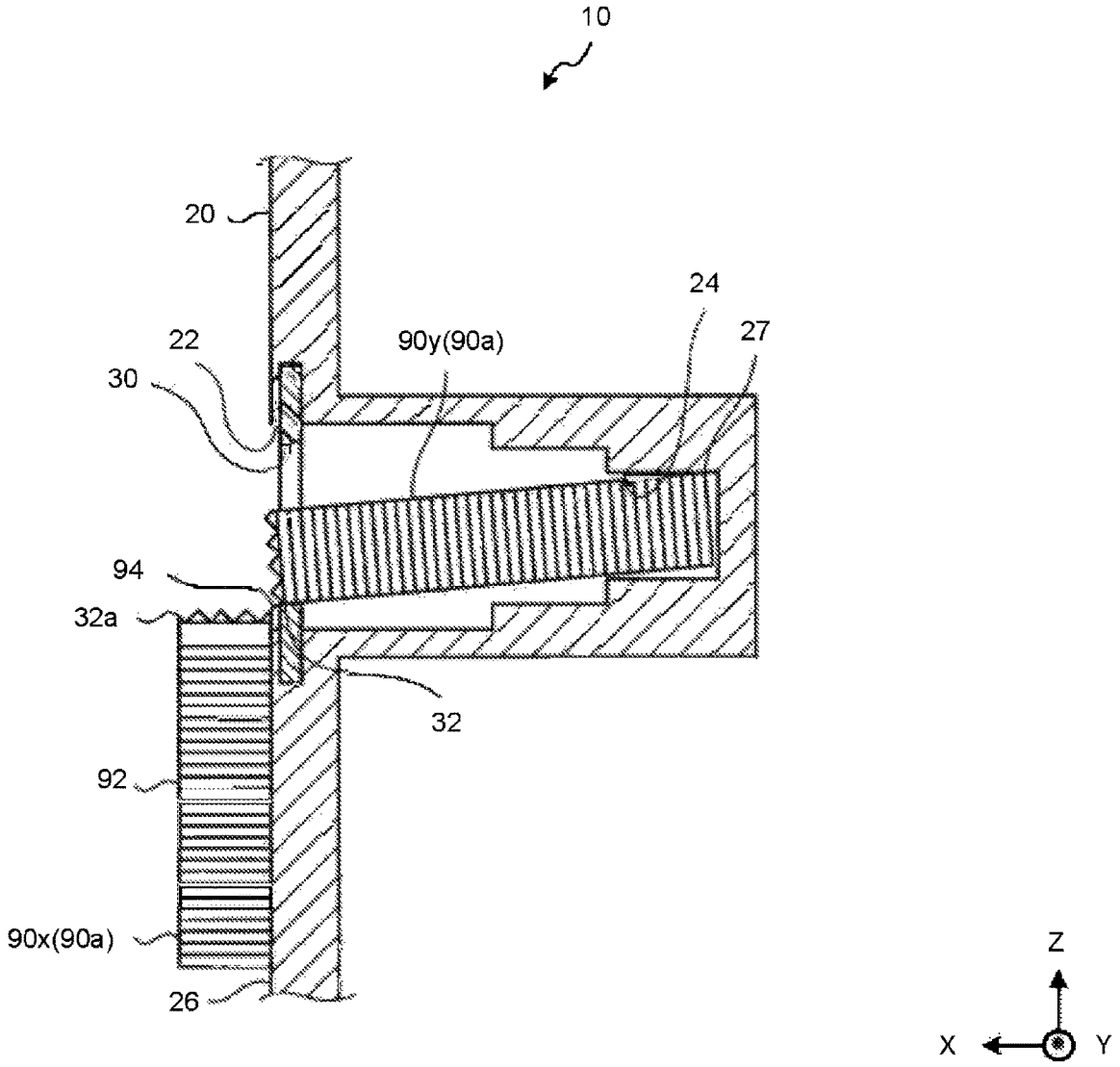
FIG. 4 is a cross-sectional view along XZ plane of the coin bar unpacking apparatus in a state in which the coin bar is unpacked.

Next, the operation of the coin bar unpacking apparatus 10 is described with reference to FIG. 4. FIG. 4 is a cross-sectional view along the XZ plane of the coin bar unpacking apparatus 10 in a state in which the coin bar 90*a* is unpacked.

If the pressing force applied in the arrow F direction shown in FIG. 2 is applied to the coin bar 90*a*, as shown in FIG. 4, since the movement of the coin bar 90*a* is restricted by the abutting section 27 and the pressure reception section 32, the pressing force applied in the arrow F direction (refer to FIG. 2) is concentrated at a point 32*a* which is on a side opposite to the point where the coin bar 90*a* abuts against the pressure reception section 32. If a pressing force is further applied, a tensile force of the film 92 for packing the coin bar 90*a* cannot withstand the force of moving the coin bar 90*a* to the Z axis negative side, and at the point 32*a*, the film 92 breaks.

Specifically, if the pressing force in the direction substantially orthogonal to the direction of the coin bar 90*a* is applied to one end, which is not inserted into the hole 24, of the coin bar 90*a*, a point to which the pressing force is applied acts as a point of application. Then, the point where the coin bar 90*a* abuts against the hole 24 at the abutting section 27 acts as a fulcrum. Furthermore, the point where the coin bar 90*a* abuts against the wrapping member 30 at the pressure reception section 32 acts as a point of action. As a result, a force in a direction to bend the coin bar 90*a* can be applied to the coin bar 90*a*. Since the breakage of the film 92 at the point 32*a* is transmitted in the direction orthogonal to the direction of the coin bar 90*a* (substantially in the Z axis negative direction), the film 92 breaks along the Z axis. The coin bar 90*a* then bends, and the side surface thereof moves to a position where the coin bar 90*a* collides with the outer surface of the housing 20, i.e., the colliding section 26.

In this way, the coin bar 90*a* can be unpacked at the position of the wrapping member 30. Then, since the breakage of the film 92 is finished when the coin bar slice 90*x* collides with the colliding section 26, the coin bar slice 90*x* and the coin bar slice 90*y* are connected by the residual film section 94 which is not broken. If the housing 20 has sufficient strength to withstand the wrapping of the coin bar 90*a*, the wrapping member 30 may not be installed.

The direction of the pressing force applied to the coin bar 90*a* may not always be constant. Then, if the direction of the pressing force is changed, the position of the abutting section 27 changes to a position corresponding to the direction of the pressing force on the inner wall of the hole 24. As the position of the abutting section 27 changes, the position of the pressure reception section 32 also changes.

The depth at which the coin bar 90*a* is inserted is not always constant. As the depth at which the coin bar 90*a* is inserted changes, the position of the abutting section 27 changes accordingly on the inner wall of the hole 24. As the position of the abutting section 27 changes, the position of the pressure reception section 32 also changes.

In order to effectively transmit the pressing force to the coin bar 90*a* and easily unpack the coin bar 90*a*, it is desirable not to move the position of the abutting section 27 formed by the tip of the coin bar 90*a* abutting against the hole 24 due to occurrence of slippage or the like until the coin bar 90*a* is unpacked. Therefore, it is desirable that the inner wall of the hole 24, particularly an area where the abutting section 27 may be formed, has an anti-slip effect, for example, by making a satin finish or the like.

Although a case in which the coin bar 90*a* is unpacked is described as an example, the unpacking mechanism is the same for the coin bars 90*b* and 90*c* (not shown).

Description of Modification of Embodiment

In the above-described embodiment, the hole 24 has a configuration in which an cross-sectional area decreases stepwise towards the back side (the X axis negative direction side), but the configuration of the hole 24 is not limited thereto.

Figure 5A:
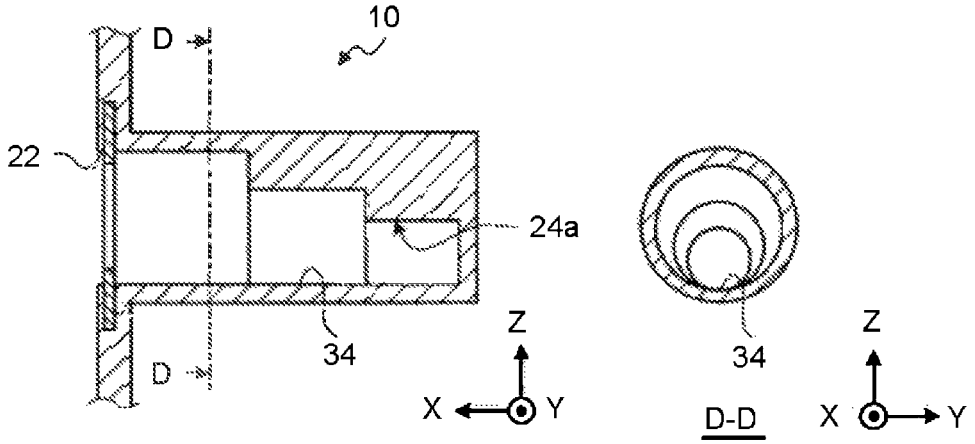
FIGS. 5(*a*)-(*c*) are cross-sectional views along XZ plane and YZ plane illustrating a modification of the hole of the coin bar unpacking apparatus according to the first embodiment.
Figure 5B:
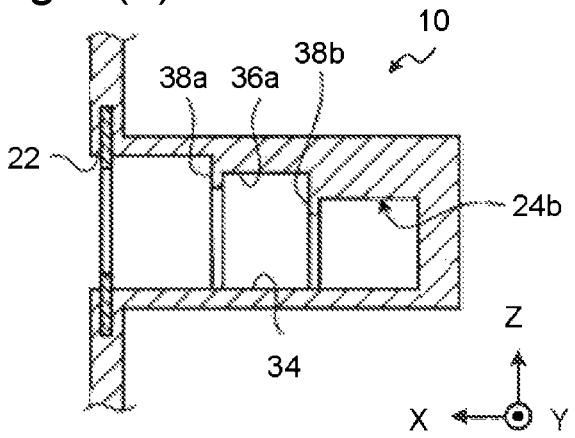
Figure 5C:
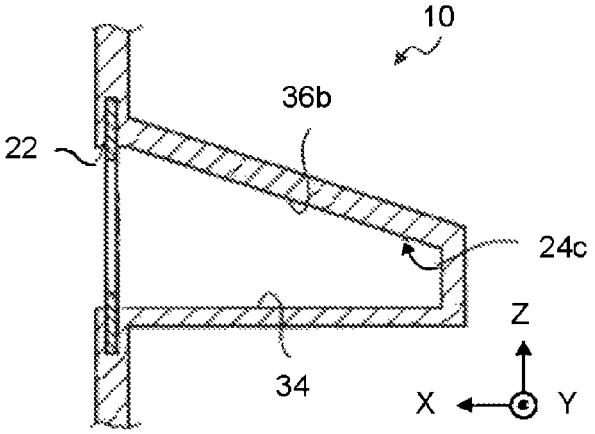

FIG. 5 is cross-sectional views along XZ plane and YZ plane illustrating a modification of the hole 24 of the coin bar unpacking apparatus 10. In particular, FIG. 5(*a*) shows an example in which a hole 24*a* is formed without setting the steps on an inner wall lower portion 34 which is the inner wall on the Z axis negative direction side with respect to the hole 24 described in the embodiment. FIG. 5(*b*) shows an example in which a hole 24*b* is formed in such a manner that ribs 38*a* and 38*b* are formed on an inner wall upper portion 36*a* with respect to the hole 24*a*. FIG. 5(*c*) shows an example in which a hole 24*c* is formed in such a manner that an cross-sectional area of the inner wall upper portion 36*b* which is the inner wall on the Z axis positive direction side decreases in a conical shape towards the back side with respect to the hole 24*a*.

According to the hole 24*a* in FIG. 5(*a*), as shown in a D-D cross-sectional view (i.e., cross-sectional view along YZ plane) obtained by cutting the cross-sectional view along the XZ plane in FIG. 5(*a*) along a cutting line D-D, there is no step on the inner wall lower portion 34. Therefore, when inserting the coin bar 90 from the opening 22, the coin bar 90 can be inserted to the back of the hole 24*a* while abutting against the inner wall lower portion 34. Therefore, the coin bar 90 can be easily inserted.

According to the hole 24*b* in FIG. 5(*b*), since there is no step on the inner wall lower portion 34, it becomes easier to insert the coin bar 90 when inserting the coin bar 90 from the opening 22. Furthermore, according to the hole 24*b*, since ribs 38*a* and 38*b* are formed on the inner wall upper portion 36*a*, it is possible to reduce the weight of the housing 20 as compared with the hole 24 described above.

According to the hole 24*c* in FIG. 5(*c*), since the cross-sectional area of the hole 24*c* becomes smaller in the conical shape towards the back side, when inserting the coin bar 90 from the opening 22, the coin bar 90 can be inserted into the back of the hole 24*c* while abutting against the inner wall upper portion 36*b* or the inner wall lower portion 34. Therefore, it becomes further easier to insert the coin bar 90.

The coin bar unpacking apparatus 10 may be manufactured as shown in FIG. 1 and placed in the vicinity of a POS terminal or the like in a retail store, or the coin bar unpacking apparatus 10 may be built in a POS terminal, a tape cutter, a drawer device, a register table, or the like.

As described above, according to the coin bar unpacking apparatus 10, by applying the pressing force in the direction substantially orthogonal to the direction of the coin bar 90 to one end of the coin bar 90 which is not inserted into the hole 24 while the coin bar 90 is being inserted into the hole 24 from the opening 22, the tip of the coin bar 90 abuts against the position of the hole 24 in response to the direction of the pressing force to form the abutting section 27 for restricting the movement of the coin bar 90 in a direction other than the insertion direction. Then, the pressure reception section 32 which receives the pressing force is formed in the vicinity of the opening 22 at a position in response to the direction of the pressing force to the one end of the coin bar 90 and the position of the abutting section 27. The formed abutting section 27 acts as the fulcrum to enable the force corresponding to the applied pressing force to the pressure reception section 32 acting as the point of action, thereby tearing up the film 92 packing the coin bar 90. Therefore, the coin bar 90 can be easily unpacked. Since the coin bar unpacking apparatus 10 does not use parts such as a cutter that need to be replaced, there is no need to replace the parts.

According to the coin bar unpacking apparatus 10, the hole 24 has a shape in which the cross-sectional area thereof decreases stepwise towards the back side. Therefore, when the coin bars 90 (90*a*, 90*b*, 90*c*) having different diameters are inserted into the hole 24, the coin bars 90 are definitely inserted to the positions corresponding to the diameters thereof, and the abutting sections 27 can be formed.

According to the coin bar unpacking apparatus 10, the hole 24*c* has such a shape that the cross-sectional area decreases in the conical shape towards the back side. Therefore, when the coin bars 90*a*, 90*b* and 90*c* having different diameters are inserted into the hole 24*c*, it is easy to insert the coin bars 90 while abutting against the wall surface of the hole 24*c*. In FIG. 5(*c*), the inner wall upper portion 36*b* and the inner wall lower portion 34 may be inverted such that the inner wall upper portion 36*b* has a shape parallel to the X axis, and the inner wall lower portion 34 is inclined downwards along the X axis positive direction side. With the hole 24*c*, the coin bar slice 90*y* (refer to FIG. 4) remaining in the hole 24*c* slides down to the X axis positive direction side, i.e., the opening 22 side, and in this way, it is easy to take out the coin bar slice 90*y* after unpacking.

Second Embodiment

Next, a second embodiment is described. FIG. 6(*a*) is a perspective view externally illustrating a coin bar unpacking apparatus 10*a* according to a second embodiment, FIG. 6(*b*) is a perspective view externally illustrating a state in which a coin bar 90 is inserted into the coin bar unpacking apparatus 10*a*, and FIG. 6(*c*) is a perspective view externally illustrating a state in which the coin bar 90 is unpacked with the coin bar unpacking apparatus 10*a*.

As shown in FIG. 6(*a*), the coin bar unpacking apparatus 10*a* has an opening 22*a* and a hole 25 continuous to the opening 22*a* on a housing 21. The opening 22*a* is formed so as to have an opening also on the Y axis positive direction side of the housing 21, in addition to the opening on the X axis positive direction side of the housing 21. In the opening 22*a*, the coin bar 90 can be inserted in the hole 25 from the side surface side of the coin bar 90, i.e., the Y axis positive direction side in addition to from the X axis positive direction side.

The inner shape of the hole 25 is similar to the hole 24 described in the first embodiment. In other words, the coin bars 90 having different diameters can be inserted to depths corresponding to the coin bars 90, respectively. A wrapping member 30*a* is installed at an end on the X axis positive direction side of the opening 22*a*. The wrapping member 30*a* is U-shaped according to the shape of the opening 22*a*. The inner shape of the hole 25 may be the shape shown in FIG. 5.

For example, the coin bar 90 is inserted in the hole 25 as shown in FIG. 6(*b*). By applying the pressing force from the arrow F direction to the inserted coin bar 90 as in the first embodiment, the coin bar unpacking apparatus 10*a* is provided with the abutting section 27 and the pressure reception section 32, which are not shown in FIG. 6. Then, the coin bar 90 is unpacked as shown in FIG. 6(*c*). Like the first embodiment, the unpacked coin bar 90 is divided into the coin bar slice 90*x* and the coin bar slice 90*y*. The coin bar slice 90*x* and the coin bar slice 90*y* are connected by the residual film section 94.

The unpacked coin bar 90 is taken out through the opening 22*a*. At that time, the coin bar 90 may be taken out from the X axis positive direction side or taken out from the Y axis positive direction side. In FIG. 6(*a*), the hole 25 is formed in a horizontal direction extending along the Y axis from the opening formed on the Y axis positive direction side, but the hole 25 may be inclined in such a manner that it becomes lower towards the Y axis negative side. As a result, the coin bar 90 inserted into the hole 25 slides down in the Y axis negative direction side along the inclination, and thus, the inserted coin bar 90 hardly slides down from the opening in the Y axis positive direction side. A surface of the hole 25 that is continuous to the opening on the X axis positive direction side of the housing 21 may be an inclined surface that becomes lower towards the X axis positive direction side. In this case, as described above, since the coin bar slice 90*y* remaining in the hole 25 slides down in the X axis positive direction side, it is possible to easily take out the coin bar slice 90*y* after unpacking.

As described above, according to the coin bar unpacking apparatus 10*a*, the opening 22*a* is formed in such a manner that the coin bar 90 can be inserted into the hole 25 even from the side surface. Therefore, the insertion of the coin bar 90 becomes further easier. Furthermore, according to the coin bar unpacking apparatus 10*a*, it is possible to easily clean the cut end of the film 92 accumulated in the hole 25, dust accumulated in the hole 25, or the like.

Third Embodiment

Figure 7A:
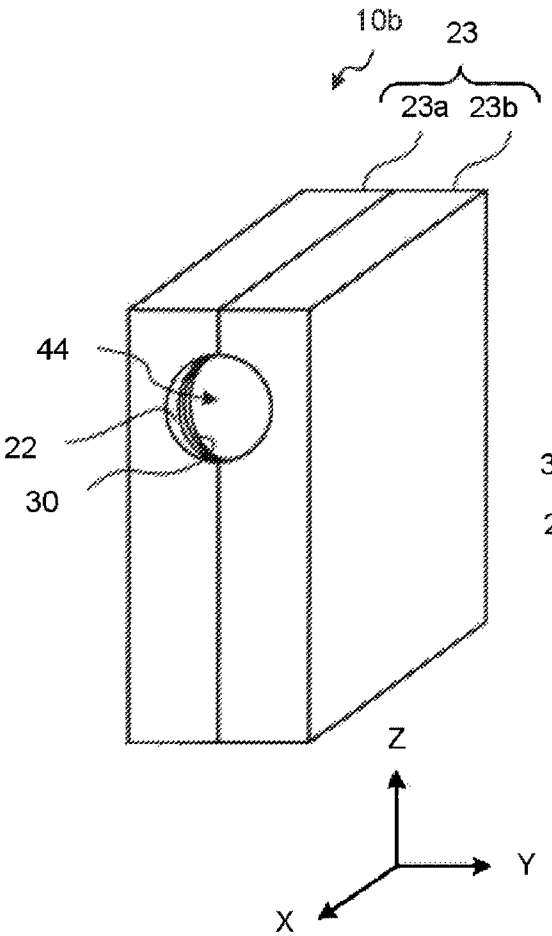
FIG. 7(*a*) is a perspective view externally illustrating a coin bar unpacking apparatus according to a third embodiment, FIG. 7(*b*) is a cross-sectional view along XZ plane of the coin bar unpacking apparatus, FIG. 7(*c*) is a perspective view externally illustrating a coin bar pressing frame.
Figure 7B:
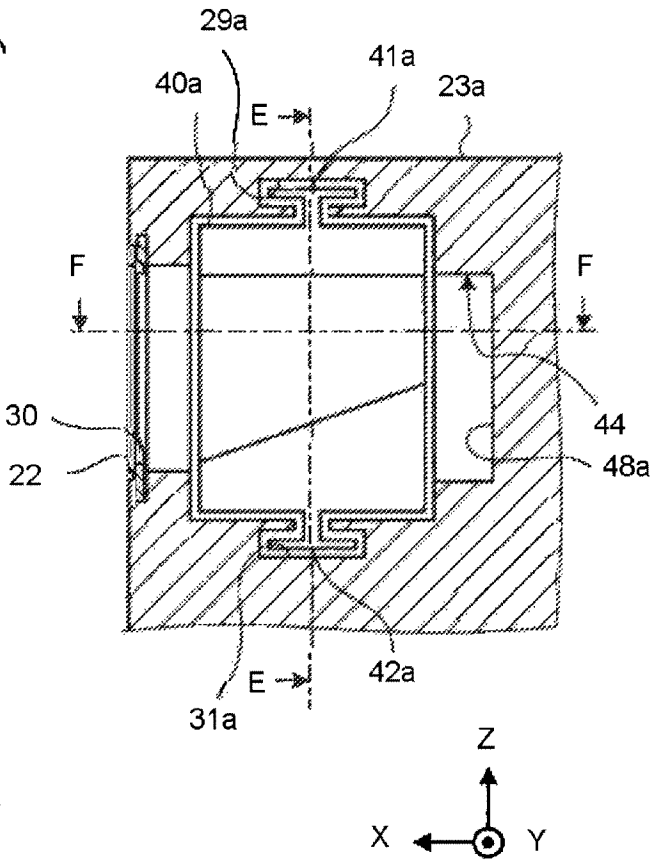
Figure 7C:
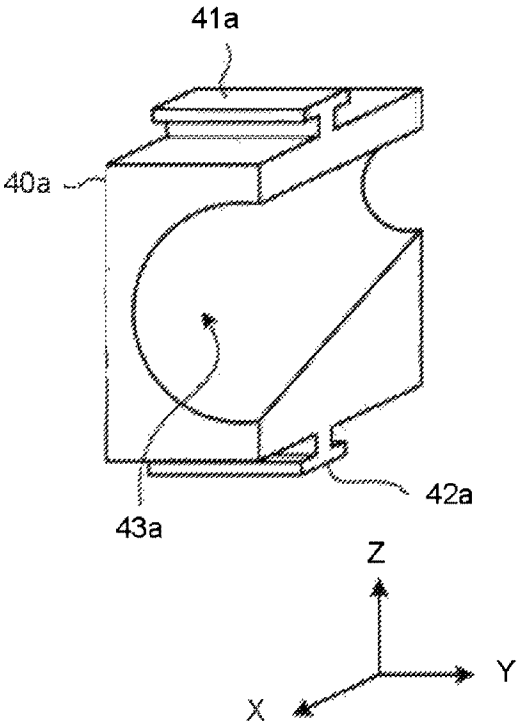

Next, the third embodiment is described. FIG. 7(*a*) is a perspective view externally illustrating a coin bar unpacking apparatus 10*b* according to the third embodiment. FIG. 7(*b*) is a cross-sectional view along XZ plane of the coin bar unpacking apparatus 10*b*. FIG. 7(*c*) is a perspective view externally illustrating the coin bar pressing frame 40*a*.

As shown in FIG. 7(*a*), the coin bar unpacking apparatus 10*b* has a hole 44 having the opening 22 in a housing 23 having a substantially rectangular parallelepiped shape. The housing 23 is formed by joining a housing 23*a* and a housing 23*b* by bonding, screwing or the like. The opening 22 is formed at a junction between the housing 23*a* and the housing 23*b*, and has a shape (for example, a substantially circular shape) into which the coin bar 90 can be inserted. The hole 44 is formed towards the inside of the housing 23 from the opening 22, and the coin bar 90 can be inserted at a depth corresponding to the coin bar 90 (not shown), for example, until the position corresponding to about the half of the length of the coin bar 90. The specific internal structure of the hole 44 is described later. For the sake of the following description, a XYZ coordinate system is set in such a manner that an extending direction of the hole 44 of the coin bar unpacking apparatus 10*b* is set as X axis, a width direction of the coin bar unpacking apparatus 10*b* is set as Y axis, and a height direction of the coin bar unpacking apparatus 10*b* is set as Z axis.

As shown in FIG. 7(*b*), the coin bar pressing frame 40*a* is provided inside the housing 23*a*. On the housing 23*b* side, the coin bar pressing frame 40*b* (refer to FIG. 8) is provided. The coin bar pressing frame 40*a* and the coin bar pressing frame 40*b* have the same shape and are installed to face each other.

The coin bar pressing frame 40*a* has an inner wall 43*a* as shown in FIG. 7(*c*). The inner wall 43*a* has a concave shape in such a manner that a diameter thereof gradually decreases from the X axis positive side to the X axis negative side. The shape of the inner wall 43*a* is the same as that of the above hole 24*c* (refer to FIG. 5(*c*)), and the inserted coin bar 90 is guided to a position corresponding to the diameter of the coin bar 90. The coin bar pressing frame 40*b* (refer to FIG. 8(*a*)) provided inside the housing 23*b* also has an inner wall 43*b* (refer to FIG. 8(*a*)) having the same shape.

A sliding section 41*a* and a sliding section 42*a* are formed at upper and lower positions in the Z axis direction of the coin bar pressing frame 40*a*. The sliding section 41*a* and the sliding section 42*a* are respectively fitted in grooves 29*a* and 31*a* formed in the housing 23*a*. The sliding sections 41*a* and 42*a* function as guide members in the housing 23*a* when the coin bar pressing frame 40*a* slides in the Y axis direction.

At the deepest position of the hole 44, a bottom surface 48*a* is formed. The wrapping member 30 is provided in the vicinity of the opening 22 similarly to the coin bar unpacking apparatus 10 of the first embodiment.

In the hole 44, the coin bar 90 is inserted from the opening 22. Then, a tip of the inserted coin bar 90 is inserted to the position of a bottom surface 48*a*. At this time, when a pressing force is applied to one end of the coin bar 90 which is not inserted into the hole 44, the tip of the coin bar 90 inserted into the hole 44 abuts against the inner wall of the hole 44 to form the abutting section 27 (refer to FIG. 4). At this time, the pressure reception section 32 (refer to FIG. 4) is formed at the end of the wrapping member 30 when unpacking the coin bar 90.

Figure 8B:
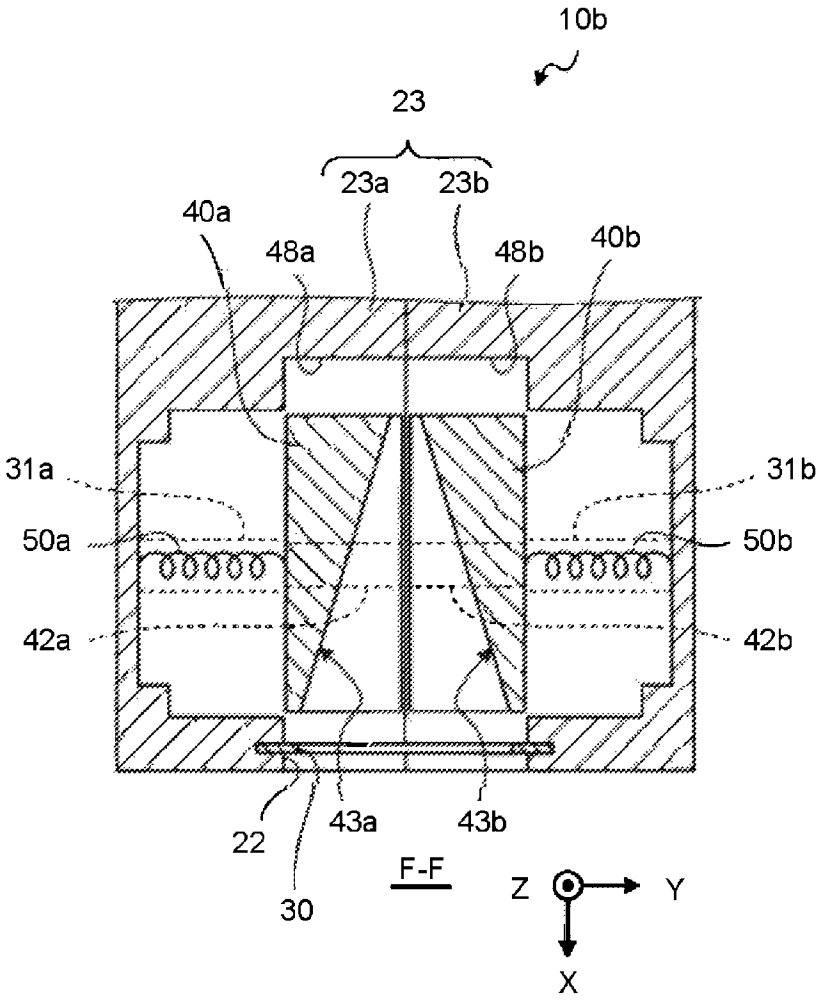
FIG. 8(*a*) is a sectional view along YZ plane of the coin bar unpacking apparatus according to the third embodiment, and FIG. 8(*b*) is a cross-sectional view along XY plane of the coin bar unpacking apparatus according to the third embodiment.
Figure 8A:
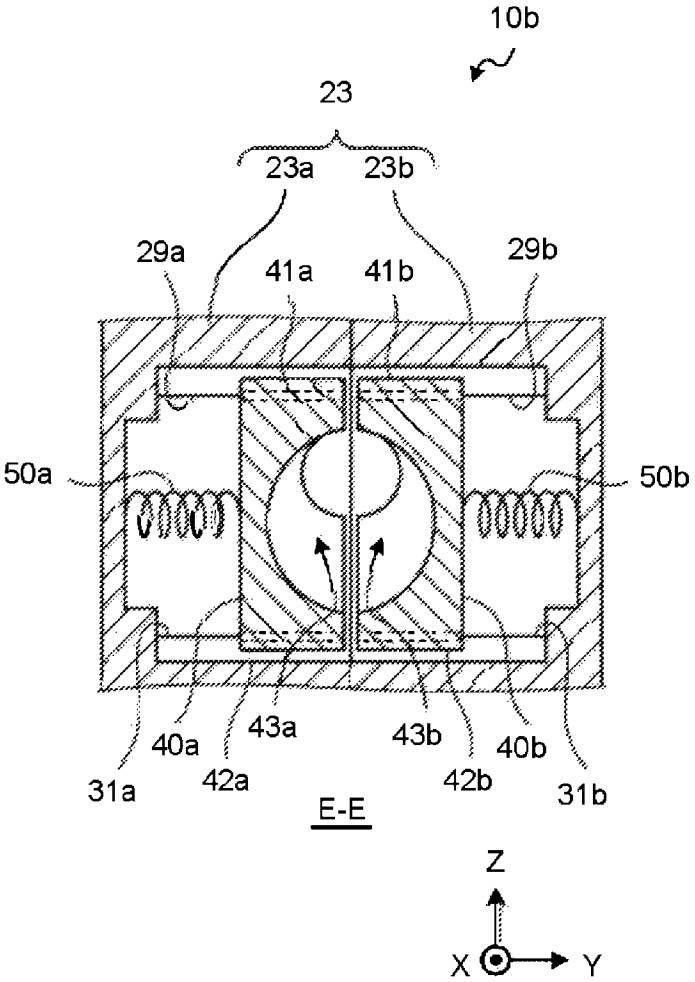

Next, the internal structure of the hole 44 is described with reference to FIG. 8. FIG. 8(*a*) is a cross-sectional view along YZ plane of the coin bar unpacking apparatus 10*b*, that is, across-sectional view taken along a line E-E in FIG. 7(*b*). FIG. 8(*b*) is a cross-sectional view along XY plane of a coin bar unpacking apparatus 10*b*, that is a cross-sectional view taken along a line F-F in FIG. 7(*b*).

As shown in FIG. 8(*a*) and FIG. 8(*b*), the coin bar pressing frame 40*a* and the coin bar pressing frame 40*b* are arranged with the inner wall 43*a* and the inner wall 43*b* facing each other. The coin bar pressing frames 40*a* and 40*b* are examples of movable walls, respectively.

As shown in FIG. 8(*a*), a spring 50*a*, which is an elastic member, is connected between the housing 23*a* and the surface on the Y axis negative side of the coin bar pressing frame 40*a*. A spring 50*b*, which is an elastic member, is connected between the housing 23*b* and the surface on the Y axis positive side of the coin bar pressing frame 40*b*. The springs 50*a* and 50*b* are, for example, metal springs. Then, the coin bar pressing frame 40*a* and the coin bar pressing frame 40*b* are respectively pressurized by the spring 50*a* and the spring 50*b* to keep a state of abutting against each other.

The sliding section 41*a* and the sliding section 42*a* provided in the coin bar pressing frame 40*a* are fitted in the grooves 29*a* and 31*a* as described above. Then, the sliding sections 41*a* and 42*a* are guided by the grooves 29*a* and 31*a* such that the coin bar pressing frame 40*a* can slide in the Y axis direction. A sliding section 41*b* and a sliding section 42*b* provided on the coin bar pressing frame 40*b* are fitted in the grooves 29*b* and 31*b*, respectively. The sliding sections 41*b* and 42*b* are guided by the grooves 29*b* and 31*b* such that the coin bar pressing frame 40*b* can slide in the Y axis direction.

As shown in FIG. 8(*b*), the inner wall 43*a* of the coin bar pressing frame 40*a* and the inner wall 43*b* of the coin bar pressing frame 40*b* are formed in such a manner that the diameters thereof are gradually reduced towards the X axis negative direction. Then, if the coin bar 90 (not shown) is inserted from the opening 22, the coin bar 90 abuts against the inner wall 43*a* and the inner wall 43*b*, and moves towards the X axis negative side while applying a force in a spreading direction to the inner wall 43*a* and the inner wall 43*b*. At this time, the coin bar pressing frames 40*a* and 40*b* receive the elastic force of the springs 50*a* and 50*b*, respectively, and thus, the insertion of the coin bar 90 is guided.

Figure 9B:
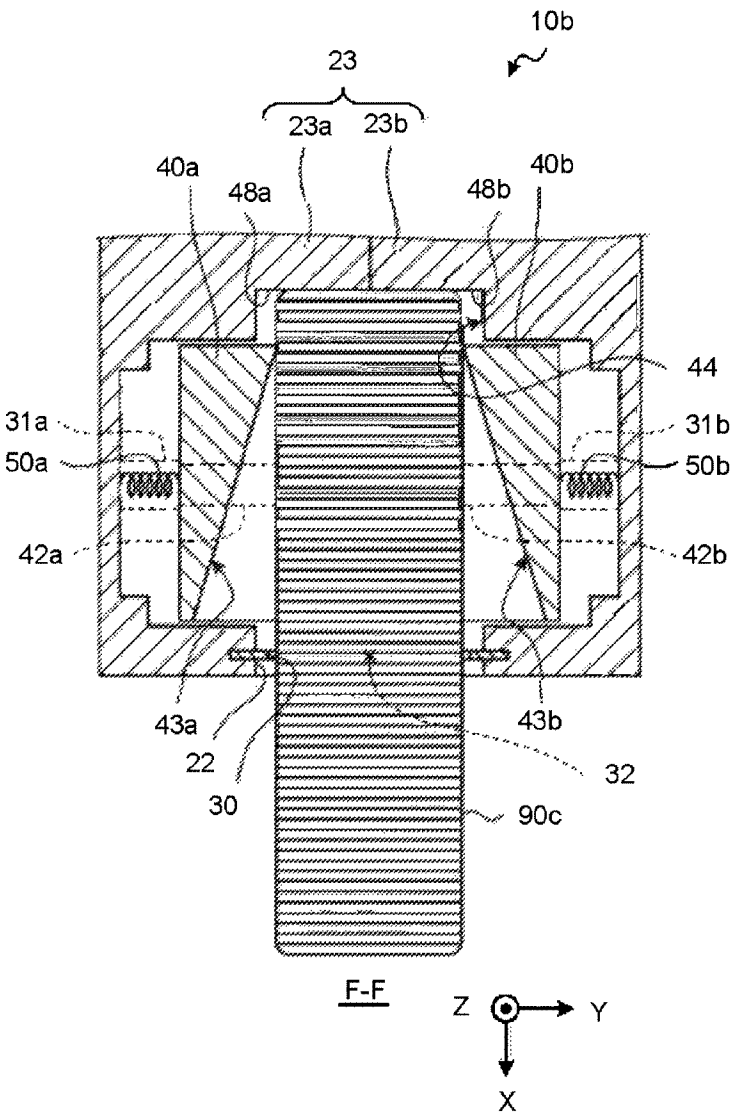
FIG. 9(*a*) is a cross-sectional view along XY plane illustrating an inserted state of a thinner coin bar to the coin bar unpacking apparatus according to the third embodiment, and FIG. 9(*b*) a cross-sectional view along XY plane illustrating an inserted state of a thicker coin bar to the coin bar unpacking apparatus according to the third embodiment.
Figure 9A:
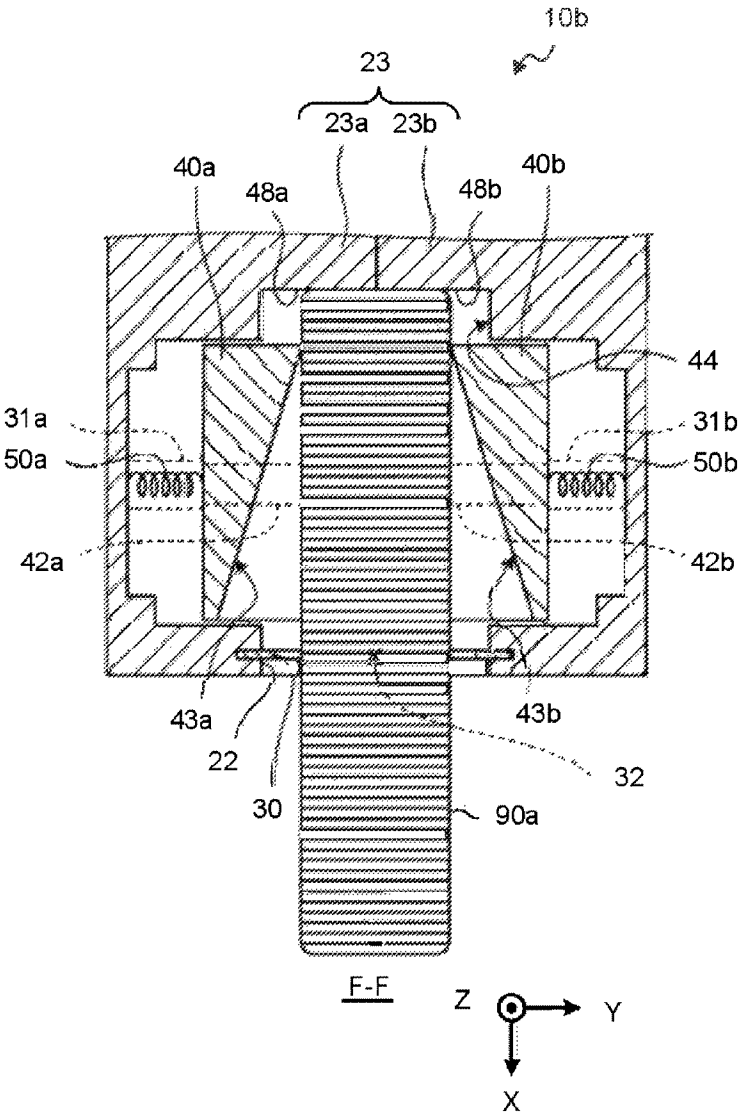

Next, with reference to FIG. 9, the operation when the coin bars 90*a* and 90*c* having different diameters are inserted into the coin bar unpacking apparatus 10*b* is described. FIG. 9(*a*) is a cross-sectional view along XY plane, that is, a cross-sectional view taken along a line F-F in FIG. 7(*b*), showing an inserted state of the thinner coin bar 90*a* to the coin bar unpacking apparatus 10*b*. FIG. 9(*b*) is a cross-sectional view along XY plane, that is a cross-sectional view taken along a line F-F in FIG. 7(*b*), showing an inserted state of the thicker coin bar 90*c* to the coin bar unpacking apparatus 10*b*.

As shown in FIG. 9(*a*), when the thinner coin bar 90*a* is inserted into the coin bar unpacking apparatus 10*b*, the tip of the coin bar 90*a* moves to the inside of the housings 23*a* and 23*b* while abutting against the inner walls 43*a* and 43*b*. At this time, the coin bar 90*a* applies a pressing force to open the inner walls 43*a* and 43*b* in the Y axis direction. The coin bar pressing frame 40*a* is moved in the Y axis negative direction by the pressing force. At that time, the sliding sections 41*a* and 42*a* (refer to FIG. 7(*b*)) provided at the upper and lower positions in the Z axis direction of the coin bar pressing frame 40*a* slide along the grooves 29*a* and 31*a* (refer to FIG. 8(*a*)) of the housing 23*a*. Therefore, the coin bar pressing frame 40*a* moves to the Y axis negative direction according to the insertion position of the coin bar 90*a* while maintaining the position thereof. Then, the coin bar pressing frame 40*a* is pressurized in the Y axis positive direction by the elastic force of the spring 50*a*. Therefore, the coin bar pressing frame 40*a* moves to a position where the pressing force in the Y axis negative direction by the coin bar 90*a* and the pressing force in the Y axis positive direction by the spring 50*a* are balanced.

Then, the coin bar pressing frame 40*b* having the inner wall 43*b* also moves to the housing 23*b* in the same manner as the coin bar pressing frame 40*a*. Specifically, the coin bar pressing frame 40*b* receives a pressing force to open in the Y axis positive direction as the coin bar 90*a* is inserted. At that time, the sliding sections 41*b* and 42*b* (refer to FIG. 8(*a*)) provided at the upper and lower positions in the Z axis direction of the coin bar pressing frame 40*b* slide along the grooves 29*b* and 31*b* (refer to FIG. 8(*a*)) of the housing 23*b*. Therefore, the coin bar pressing frame 40*b* moves to the Y axis positive direction according to the insertion position of the coin bar 90*a* while maintaining the position thereof. Then, the coin bar pressing frame 40*b* is pressurized in the Y axis negative direction by the elastic force of the spring 50*b*. Therefore, the coin bar pressing frame 40*b* moves to a position where the pressing force in the Y axis positive direction by the coin bar 90*a* and the pressing force in the Y axis negative direction by the spring 50*b* are balanced.

The tip of the inserted coin bar 90*a* reaches the positions of the bottom surfaces 48*a* and 48*b* of the hole 44. The bottom surface 48*b* is the bottom surface of the hole 44 which is formed on the housing 23*b* side. At this time, the inner wall 43*a* and the inner wall 43*b* are in a state of being spread apart from each other, meanwhile, a force in a direction to sandwich the coin bar 90*a* acts on the inner walls 43*a* and 43*b* from the springs 50*a* and 50*b*, and thus, the coin bar 90*a* is grasped by the coin bar pressing frames 40*a* and 40*b* without rattling.

When the coin bar 90*a* is in the state of being inserted into the position of the bottom surfaces 48*a* and 48*b*, as described in the first embodiment, a pressing force in a direction substantially orthogonal to the direction of the coin bar 90*a*, i.e., towards the substantially Z axis negative direction is applied to one end, which is not inserted into the hole 44, of the coin bar 90*a*. Then, the tip of the coin bar 90*a* abuts against the inner wall of the hole 44 to form the abutting section 27 (not shown in FIG. 9(*a*)). A portion on the opening 22 side of the coin bar 90*a* then abuts against the wrapping member 30 to form the pressure reception section 32. In this way, when the pressing force is further applied in a state in which the abutting section 27 and the pressure reception section 32 are formed, the coin bar 90*a* is unpacked at a position corresponding to the abutting section 27 and the pressure reception section 32.

On the other hand, as shown in FIG. 9(*b*), when the thicker coin bar 90*c* is inserted, the coin bar pressing frames 40*a* and 40*b* also operate similarly. In this case, since the coin bar 90*c* is thicker than the coin bar 90*a*, the amount of movement of the coin bar pressing frames 40*a* and 40*b* becomes larger than that in the case of FIG. 9(*a*). However, even in this case, the tip of the coin bar 90*c* is inserted to the position of the bottom surfaces 48*a* and 48*b*. Then, as described above, when the pressing force in the direction substantially orthogonal to the direction of the coin bar 90*c* is applied to one end, which is not inserted into the hole 44, of the coin bar 90*c*, the abutting section 27 (not shown) and the pressure reception section 32 are formed, and the coin bar 90*c* is unpacked at a position corresponding to the abutting section 27 and the pressure reception section 32.

As described above, according to the coin bar unpacking apparatus 10*b*, when inserting the coin bar 90, the hole 44 is provided with the coin bar pressing frames 40*a* and 40*b* moving to positions corresponding to the diameter of the coin bar 90 while abutting against the coin bar 90. Therefore, it is possible to insert the tip of the coin bar 90 to the positions of the bottom surfaces 48*a* and 48*b* of the hole 44, regardless of the diameter of the coin bar 90 (90*a*, 90*b*, 90*c*). Therefore, since the length of a portion protruding from the opening 22 in the coin bar 90 inserted into the hole 44 is substantially equal regardless of the diameter of the coin bar 90, it is possible to unpack the coin bar 90 with substantially equal pressing force regardless of the diameter of the coin bar 90.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A coin bar unpacking apparatus, comprising:

a housing including an opening and a hole configured to accommodate a packed coin bar inserted through the opening, the hole extending in an insertion direction of packed coin bar and decreasing in diameter along the insertion direction such that a first diameter of the hole at a first location is greater than a second diameter of the hole at a second location that is farther from the opening than the first location, wherein an inner surface of the housing at the second location restricts movement of the packed coin bar in a first direction when the packed coin bar is pressed against a rim of the opening in a second direction that is opposite to the first direction.

2. The coin bar unpacking apparatus according to claim 1, wherein the hole diameter decreases in a step manner along the insertion direction.

3. The coin bar unpacking apparatus according to claim 1, wherein the hole diameter decreases in a continuous manner along the insertion direction.

4. The coin bar unpacking apparatus according to claim 1, wherein the insertion direction is substantially perpendicular to a side face of the housing through which the opening is formed.

5. The coin bar unpacking apparatus according to claim 1, wherein the hole is formed by movable walls that apply a compressive force towards a center longitudinal axis of the hole by spring members.

6. The coin bar unpacking apparatus according to claim 5, wherein an end portion of hole along the insertion direction is at the second location and is formed by the inner surface of the housing.

7. The coin bar unpacking apparatus according to claim 1, wherein the housing includes a first housing having a first opening and a first hole, and a second housing having a second opening and a second hole, and the first housing is joined to the second housing such that the opening is formed from the first opening and the second opening, and the hole is formed from the first hole and the second hole.

8. The coin bar unpacking apparatus according to claim 1, wherein a bottom portion of the hole extends horizontally and a top portion of the hole is sloped downwardly.

9. The coin bar unpacking apparatus according to claim 1, wherein a top portion of the hole extends horizontally and a bottom portion of the hole is sloped upwardly.

10. A coin bar unpacking apparatus, comprising:

a housing including an opening and a hole configured to accommodate a packed coin bar inserted through the opening, the hole extending in an insertion direction of packed coin bar and decreasing in width along the insertion direction such that a first width of the hole at a first location is greater than a second width of the hole at a second location that is farther from the opening than the first location, wherein an inner surface of the housing at the second location restricts movement of the packed coin bar in a first direction when the packed coin bar is pressed against a rim of the opening in a second direction that is opposite to the first direction.

11. The coin bar unpacking apparatus according to claim 10, wherein the hole has a circular cross-section and the width is equal to a diameter of the circular cross-section.

12. The coin bar unpacking apparatus according to claim 10, wherein the hole has a non-circular cross-section and the width is equal to a width of the non-circular cross-section along a direction that is transverse to the insertion direction.

13. The coin bar unpacking apparatus according to claim 10, wherein the hole width decreases in a step manner along the insertion direction.

14. The coin bar unpacking apparatus according to claim 10, wherein the hole width decreases in a continuous manner along the insertion direction.

15. The coin bar unpacking apparatus according to claim 10, wherein the insertion direction is substantially perpendicular to a side face of the housing through which the opening is formed.

16. The coin bar unpacking apparatus according to claim 10, wherein the housing includes a first housing having a first opening and a first hole, and a second housing having a second opening and a second hole, and the first housing is joined to the second housing such that the opening is formed from the first opening and the second opening, and the hole is formed from the first hole and the second hole.

17. The coin bar unpacking apparatus according to claim 10, wherein the hole is formed by movable walls that apply a compressive force towards a center longitudinal axis of the hole by spring members.

18. The coin bar unpacking apparatus according to claim 17, wherein an end portion of hole along the insertion direction is at the second location and is formed by the inner surface of the housing.

19. The coin bar unpacking apparatus according to claim 10, wherein a bottom portion of the hole extends horizontally and a top portion of the hole is sloped downwardly.

20. The coin bar unpacking apparatus according to claim 10, wherein a top portion of the hole extends horizontally and a bottom portion of the hole is sloped upwardly.

* * * * *